United States Patent [19]

Reed et al.

[11] 4,105,394

[45] Aug. 8, 1978

[54] DUAL PRESSURE FLARE

[75] Inventors: Robert D. Reed; John S. Zink; Robert E. Schwartz, all of Tulsa, Okla.

[73] Assignee: John Zink Company, Tulsa, Okla.

[21] Appl. No.: 733,143

[22] Filed: Oct. 18, 1976

[51] Int. Cl.[2] ..... F23Q 9/00

[52] U.S. Cl. ..... 431/202; 23/277 C; 431/5; 431/284

[58] Field of Search ..... 431/5, 202, 284, 285, 431/278; 23/277 C

[56] References Cited

U.S. PATENT DOCUMENTS

| | | | |
|---|---|---|---|
| 3,697,231 | 10/1972 | Reed | 23/277 C |
| 3,817,687 | 6/1974 | Cavallero et al. | 431/202 |
| 3,822,985 | 7/1974 | Straitz | 431/284 |
| 3,824,073 | 7/1974 | Straitz | 431/284 |
| 3,994,671 | 11/1976 | Straitz | 431/202 |

*Primary Examiner*—Edward G. Favors

*Attorney, Agent, or Firm*—Head, Johnson & Chafin

[57] ABSTRACT

A smokeless burner apparatus for single structure flare systems which is capable of simultaneously burning emergency dumped gases from high and low pressure sources with minimal energy requirements for the low pressure gas combustion.

10 Claims, 5 Drawing Figures

DUAL PRESSURE FLARE

BACKGROUND OF THE INVENTION

It is well known in the art that flaring of low pressure hydrocarbon gases having a molecular weight ratio of hydrogen to carbon less than 0.30 tends to produce smoke as a result of incomplete combustion and the formation of free carbon. The release of free carbon to the atmosphere creates a dark smoke plume which is unsightly and a matter of poor ecological practice. Of the various means devised for coping with said smoke generation, two methods have gained primary attention. The first method involves the introduction of a smoke suppressant, typically steam or water, to the combustion zone. The water, in vapor phase, reacts with the hydrocarbon by familiar and well-known endothermal reactions. The second method relates to the use of air-powered flares which provide turbulent mixing of air with the hydrocarbon gas for complete smokeless combustion.

The flaring of high pressure hydrocarbon gases is different, however, and does not require additional energy as the relatively high pressure of the gas, upon release, provides sufficient kinetic energy for the system to operate smokelessly. Since the flaring of low pressure gas requires additional energy to be imparted to the system, and, whereas the flaring of high pressure gas does not require additional energy, separate flare systems are normally used for the different pressure waste gases, because lower pressure gas obviously cannot be vented to relief lines carrying gas at a higher pressure. This results in high capital and maintenance costs, the disadvantages of which are apparent.

SUMMARY OF THE INVENTION

The present invention contemplates a flaring means particularly designed to overcome the aforementioned disadvantages, and it is a primary object of this invention to provide a means for single flare structure smokeless flaring of smoke-prone combustible waste gases which are emergency dumped by separate relief lines from sources of high and low pressure gas.

It is a further object of this invention to provide a single relief line flaring system to a single flare for operations where high pressure and low pressure venting does not occur simultaneously.

It is a further object of this invention to achieve economy in the simultaneous flaring of both high and low pressure gases in a single flare structure by use of the energy of the high pressure gas to provide the required turbulent air and gas mixture for complete combustion for the high-pressure gases as discharged for burning.

These and other objects are realized by the incorporation of high pressure and low pressure burner apparatus in a single flaring structure. If the process being relieved does not require the simultaneous venting of high and low pressure gases, the dual pressure burner apparatus may be served by a single relief line. The economy achieved by using a single relief line instead of separate relief lines for the high and low pressure gas sources is readily apparent. A pressure control means is attached to the relief line to sense pressure and permit gas flow to the high pressure burner apparatus above predetermined pressures.

If simultaneous venting of high and low pressure gases is required by process conditions, it has been discovered that both gases may be flared simultaneously in the same stack without interference with the stable and smokeless operation of the flare. Furthermore, while the flaring of the low pressure gas requires fan or blower supplied air, the simultaneous combustion of low and high pressure gas minimizes the additional energy requirements due to the aspiration or air induction created by the discharge of the high pressure gas.

DESCRIPTION OF THE PREFERRED EMBODIMENTS

Figure 1:
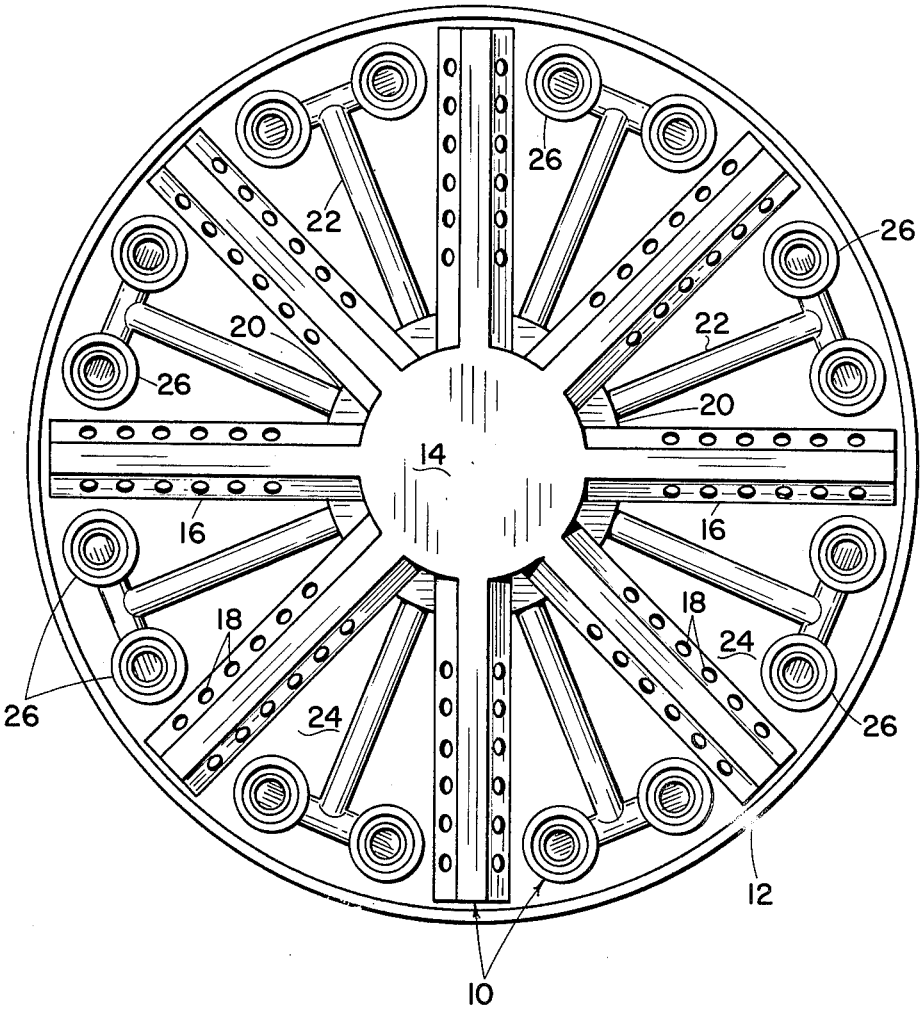
FIGS. 1, 2, and 3 are top elevational views of three dual pressure burners embodying the invention.
Figure 2:
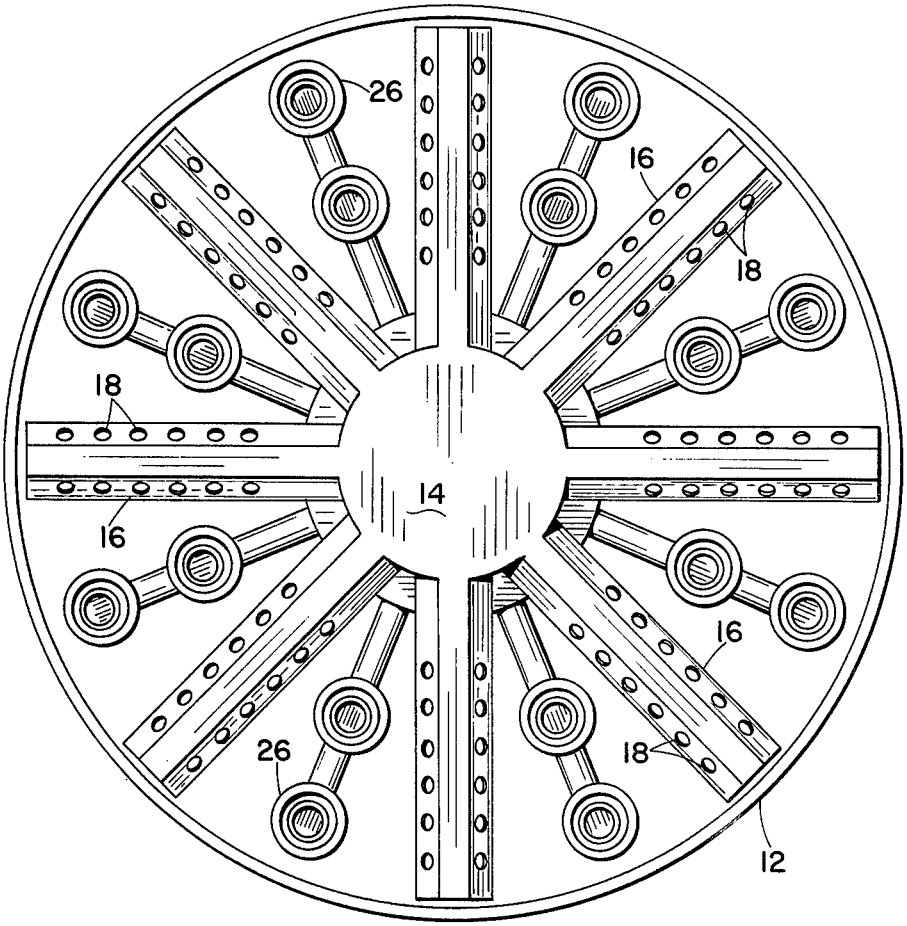
Figure 3:
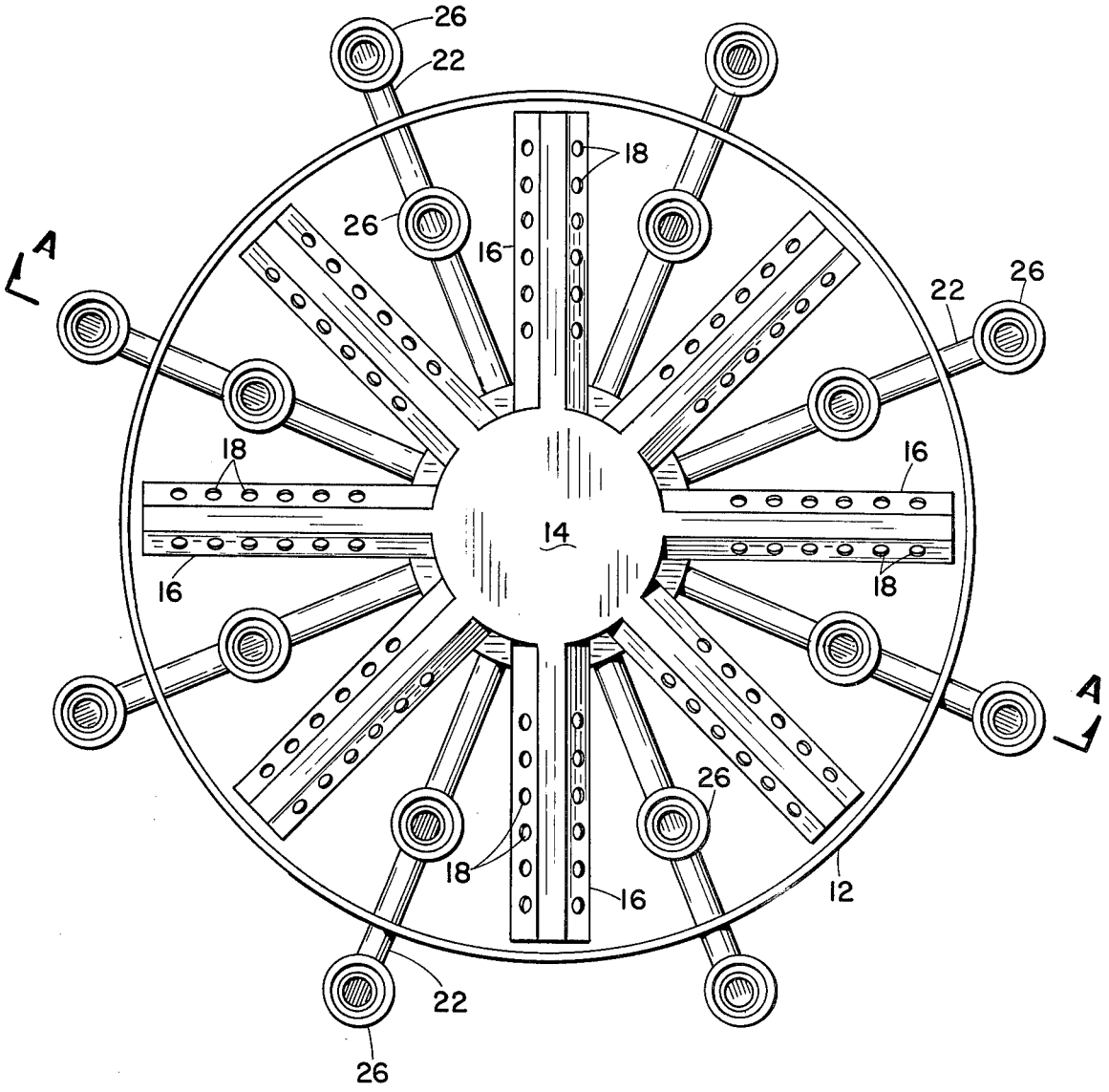

Referring to the drawings in detail and in particular to FIG. 1, reference character 10 generally indicates a dual pressure burner apparatus concentrically located within air duct 12, which is normally the flare stack proper. As will become apparent later, the flare stack serves as a conduit for forced or induced air circulation to the low pressure gas discharge apertures. Spider hub 14 is comprised of a housing having a chamber therein for receiving low pressure gas from below (not shown) and having a plurality of spaced apertures through said housing in open communication with the chamber. Hollow spider arms 16 are affixed to said housing in open communication with the chamber and extend radially from the housing. Each spider arm is closed at the outer end and has a plurality of spaced apertures 18 laterally disposed along both sides thereof to direct the low pressure gas towards air space 24. A high pressure gas supply housing 20, providing a second chamber and having a plurality of outlets through said housing in open communication with the chamber is disposed circumferentially around spider hub 14, beneath spider arms 16. Hollow supply ducts 22 are secured to the high pressure housing in open communication with the housing outlets and with burner tips 26. High pressure gas enters the chamber provided by housing 20 from below (not shown) and passes through the chamber to burner tips 26 via supply ducts 22. As shown in FIG. 1, the burner tips 24 are disposed between pairs of adjacent spider arms 16 at a common radial distance from the center of the spider hub. A second arrangement is shown in FIG. 2 wherein the burner tips 26 are located at separate radial distance. FIG. 3 discloses a third arrangement wherein a portion of the high pressure gas supply ducts 22 extend through the walls of the flare stack to serve high pressure burner tips outside the walls thereof as well as burner tips located inside the flare stack walls.

Figure 4:
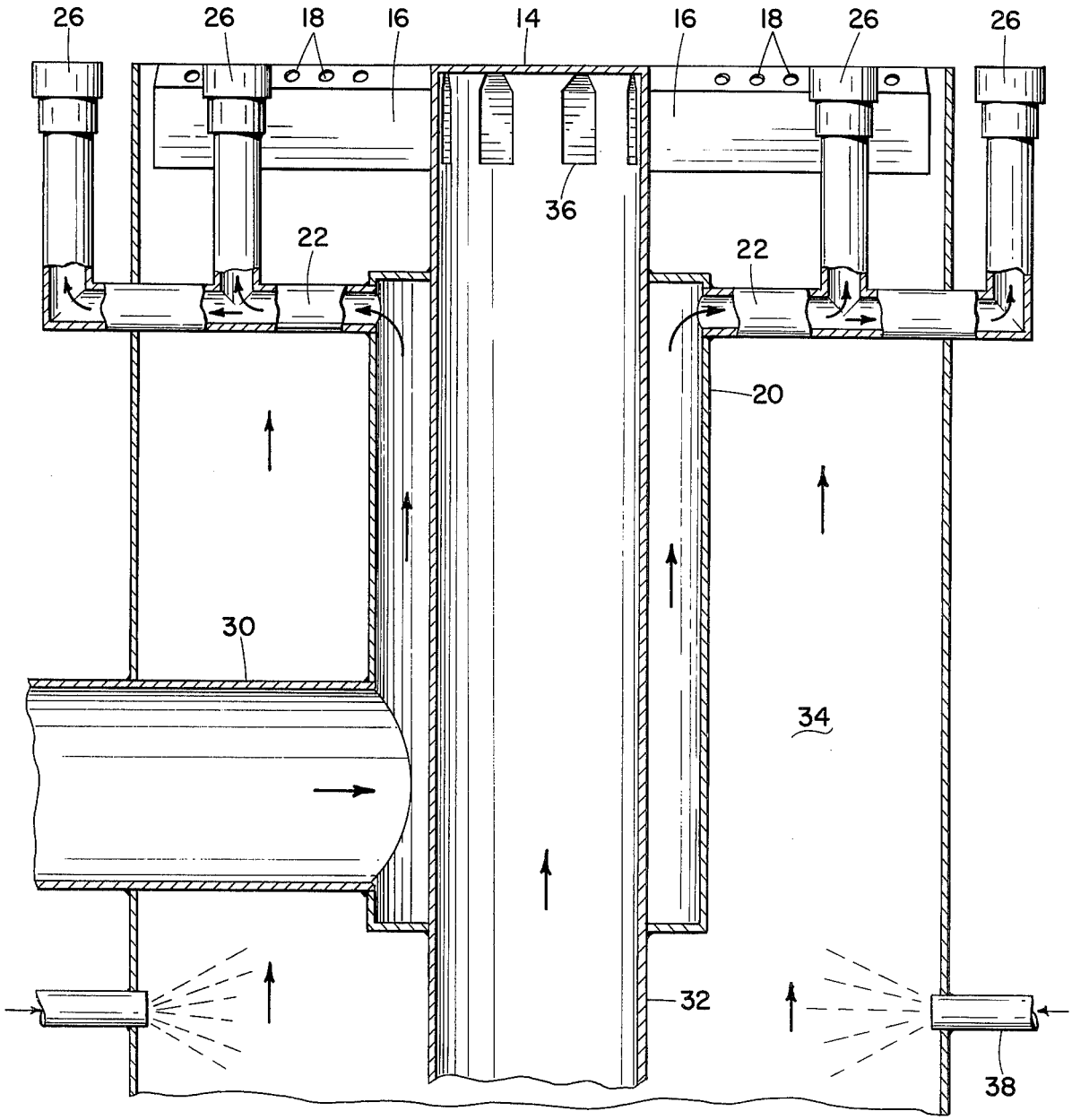
FIG. 4 is a view taken on line A—A of FIG. 3.

FIG. 4 shows a cross section of FIG. 3 taken along section A—A thereof. As indicated in said figure, high pressure gas is admitted to the high pressure gas supply housing 20 through line 30, and low pressure gas is supplied to the spider hub by line 32. The spaced apertures in the low pressure gas housing previously mentioned are indicated herein generally by reference figure 36. An inlet 38 is provided for the introduction of water or steam to the stack beneath the burners for further smoke suppression if needed. During the simultaneous combustion of high and low pressure gas, air is aspirated as inducted through the inside of the flare stack 34 towards the top thereof, thus aiding the supplying of air for the low pressure gas.

Figure 5:
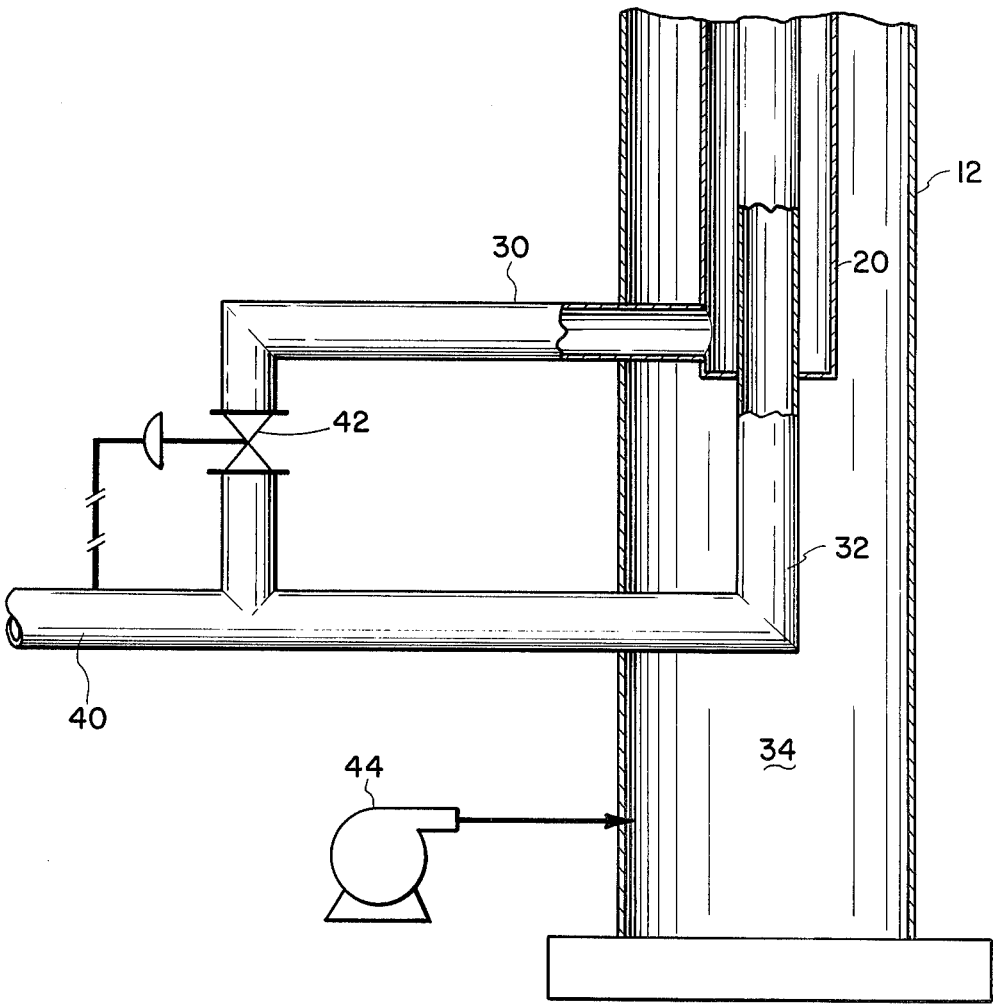
FIG. 5 is a side view, partly in section of a system for single relief line flaring.

FIG. 5 represents the invention as contemplated for use in a single relief line flare system. As previously noted, a single relief line 40 can serve only those processes which do not require simultaneous venting of high and low pressure gas. Valve 42 is pressure controlled to open whenever the pressure of the relief line exceeds a predetermined pressure, thus admitting gas to the high pressure gas supply housing as well as the low pressure housing. Blower 44 provides air for the smokeless burning of the low pressure gas.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. A dual pressure burner apparatus for a flare stack, comprising a thin wall circular metal pipe, said burner apparatus comprising:

a first housing providing a first chamber having an inlet port therein for admitting low pressure gas into said chamber and having a plurality of spaced outlet ports extending through the walls thereof and spaced above the inlet port;

a plurality of hollow arms secured to the first housing, each arm being in substantial alignment with each outlet port and extending outwardly from the first housing, each arm having one end in open communication with the first chamber and the opposite end closed, each arm having spaced apertures disposed along both sides of each arm for the escape of low pressure gas said arms extending substantially to the inner surface of said stack, whereby atmospheric air is directly available for combustion of said low pressure gas over the top edge of said flare stack;

means for securing the first housing and arms concentrically inside the flare stack, near the top portion thereof;

a second housing providing a second chamber having an opening for receiving high pressure gas into said second chamber and having an outlet means for discharging said high pressure gas;

a plurality of ducts secured to the second housing in open communication with the outlet means thereof for receiving the high pressure gas, each of said ducts being interposed between adjacent pairs of the low pressure hollow arms and having outlet bore means for discharge of the high pressure gas said outlet bore means for each of said ducts comprising at least one burner having a total high pressure gas flow in close proximity to the inner surface of said flare stack, near the top thereof, whereby atmospheric air is directly available for combustion of said high pressure gas over the top edge of said flare stack;

means attached to each of said ducts in communication with the outlet bore means for burning the high pressure gas; and means to supply low pressure air to the inside of said flare stack.

2. A dual pressure burner apparatus for a flare stack, as recited in claim 1, which further comprises:

means for injecting $H_2O$ into said flare stack upstream of said burner apparatus.

3. A dual pressure burner apparatus for a flare stack, as recited in claim 1, wherein the first housing is cylindrically shaped and in axial alignment with the flare stack.

4. A dual pressure burner apparatus for a flare stack, as recited in claim 3, wherein the second housing is concentrically placed around the first housing.

5. A dual pressure burner apparatus for a flare stack, which comprises:

a first housing providing a first chamber having an inlet port therein for admitting low pressure gas into said chamber and having a plurality of spaced outlet ports extending through the walls thereof and spaced above the inlet port;

a plurality of hollow arms secured to the first housing, each arm being in substantial alignment with each outlet port and extending outwardly from the first housing, each arm having one end in open communication with the first chamber and the opposite end closed, each arm having spaced apertures disposed along both sides of each arm for the escape of low pressure gas;

means for securing the first housing and arms concentrially inside the flare stack, near the top portion thereof;

a second housing providing a second chamber having an opening for receiving high pressure gas into said chamber and having an outlet means for discharging said high pressure gas;

a plurality of ducts secured to the second housing in open communication with the outlet means thereof for receiving the high pressure gas, each of said ducts being interposed between adjacent pairs of the low pressure hollow arms, extending radially through the side walls of the flare stack and having a plurality of outlet bore means for discharge of the high pressure gas, each duct having at least one outlet bore means located within the perimeter of the flare stack and at least one outlet bore means located outside the perimeter of the flare stack; and means attached to each of said ducts in communication with the outlet bore means for burning the high pressure gas.

6. A dual pressure burner apparatus for a single relief line air powered flare stack, which comprises:

a first housing providing a first chamber having an inlet port therein for admitting gas into the first chamber and having a plurality of spaced outlet ports extending through the walls thereof in open communication with the first chamber and spaced above the inlet port;

a plurality of hollow arms secured to the first housing, each arm being in substantial alignment with each outlet port and extending outwardly from the housing, each arm having one end in open communication with the chamber and the opposite end closed, each arm having spaced apertures disposed along both sides of each arm for the escape of gas;

means for securing the first housing and arms concentrically inside the flare stack, near the top portion thereof;

a second housing providing a second chamber having an opening for receiving high pressure gas therein in open communication with the second chamber and having an outlet means for discharging said high pressure gas;

a plurality of ducts secured to the second housing in open communication with the outlet means thereof for receiving the high pressure gas, each of said ducts being interposed between adjacent pairs of the hollow arms and having outlet bore means for discharge of the high pressure gas;

means attached to each of said ducts in communication with the outlet bore means for burning the high pressure gas;

conduit means for supply of high and low pressure gas to be burned, and means to connect said conduit means to said first chamber;

valve means connecting said conduit means to said second chamber; and control means responsive to the pressure of gas inside said conduit means to open said valve;

whereby when said gas pressure is lower than a selected pressure, gas is supplied only to said first chamber; and when said gas pressure is higher than said selected pressure, gas is supplied to both said first and second chamber.

7. A dual pressure burner apparatus for a single relief line, air powered flare stack, as recited in claim 6, which further comprises means for injecting $H_2O$ into said flare stack for further smoke suppression.

8. A dual pressure burner apparatus for a single relief line air powered flare stack, as recited in claim 6, wherein the first housing is cylindrically shaped in axial alignment with the flare stack.

9. A dual pressure burner apparatus for a single relief line air powered flare stack, as recited in claim 8, wherein the second housing is concentrically placed around the first housing.

10. The apparatus as in claim 1 including;

d. single gas conduit means to supply high and low pressure gas to said first inlet means;

e. valve means connecting said single gas conduit means to said second inlet means; and f. control means responsive to the gas pressure in said single gas conduit means upstream of said valve means;

whereby when said gas pressure in said inlet gas conduit means is lower than a selected value, all of the gas flows into said first inlet means, and when said gas pressure is greater than said selected value, said valve opens and gas flows into both said first inlet means and said second inlet means.

* * * * *